US008475116B2

(12) United States Patent
Trommer et al.

(10) Patent No.: US 8,475,116 B2
(45) Date of Patent: Jul. 2, 2013

(54) ANTI-ROTATION FEATURE FOR AIR TURBINE STARTER

(75) Inventors: William C. Trommer, Byron, IL (US); Jeffrey M. Makulec, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 442 days.

(21) Appl. No.: 12/842,094

(22) Filed: Jul. 23, 2010

(65) Prior Publication Data

US 2012/0020784 A1 Jan. 26, 2012

(51) Int. Cl.
*F01D 15/12* (2006.01)

(52) U.S. Cl.
USPC ..... 415/122.1; 415/126; 415/129

(58) Field of Classification Search
USPC ..... 415/229, 230, 122.1, 126, 127
See application file for complete search history.

(56) References Cited

U.S. PATENT DOCUMENTS 4,513,215 A 4/1985 Del Serra
5,009,300 A 4/1991 Romig
5,247,855 A 9/1993 Alten et al.
5,511,885 A * 4/1996 Coleman ..... 384/439
5,647,799 A 7/1997 Gall et al.
5,769,720 A 6/1998 Aiken et al.
6,527,660 B1 3/2003 Sugden
6,747,383 B2 * 6/2004 Tornquist et al. ..... 310/91
6,971,802 B2 * 12/2005 Vezina ..... 384/517
7,250,688 B2 7/2007 Thomson et al.
7,431,512 B2 * 10/2008 Young ..... 384/535
7,708,663 B2 5/2010 Himmelmann
7,737,591 B2 6/2010 Himmelmann et al.

* cited by examiner

*Primary Examiner* — Nathaniel Wiehe
*Assistant Examiner* — Justin Seabe
(74) *Attorney, Agent, or Firm* — Carlson, Gaskey & Olds, PC

(57) ABSTRACT

A turbine balance assembly has a turbine rotor and shaft. Bearings are positioned radially outwardly of the shaft. A bearing sleeve is positioned radially outwardly of the bearings, and supports the bearings. The bearing sleeve extends along an axial length defined by a rotational axis of the shaft, and has a turbine rotor end adjacent to the turbine rotor, and a remote end. A radially outwardly extending flange on the bearing sleeve extends radially outwardly of a support portion of the bearing sleeve at the turbine rotor end. The flange has a nominal outer diameter, and includes a slot for receiving an anti-rotation tab from a gear cage over a first circumferential extent. A bearing sleeve incorporates the anti-rotation feature, and a gear cage incorporates its portion of the anti-rotation feature. An air turbine starter, and a method of installing components of a turbine balance assembly are also disclosed.

17 Claims, 5 Drawing Sheets

ANTI-ROTATION FEATURE FOR AIR TURBINE STARTER

BACKGROUND

This application relates to an anti-rotation feature between a gear cage, and a bearing sleeve in an air turbine starter turbine assembly.

Air turbine starter turbine assemblies are utilized to provide a starter function in gas turbine engines. In a typical air turbine starter turbine assembly, an auxiliary power unit (APU) is utilized to provide power prior to start-up of the main gas turbine engine. The compressed air from the APU is directed into an inlet of the air turbine starter turbine assembly, and drives a turbine rotor to rotate. The turbine rotor rotates, and serves as a starter motor for the main gas turbine engine.

A bearing sleeve surrounds a turbine shaft, and a plurality of bearings support the shaft within the bearing sleeve. During drive of the air turbine starter turbine assembly, there are rotational forces applied to the bearing sleeve, which could cause it to rotate. The bearing sleeve extends from a turbine rotor end adjacent to the turbine rotor, and to a gear end adjacent to a planetary gear.

In the prior art, a pin or other lock locks the bearing sleeve to a gear cage at the gear end of the bearing sleeve. With vibration and use, debris can be generated, and the debris can gain access into the interior of the air turbine starter turbine assembly.

SUMMARY

A turbine balance assembly has a turbine rotor connected to drive a turbine shaft. Bearings are positioned radially outwardly of the turbine shaft. A bearing sleeve is positioned radially outwardly of the bearings, and supports the bearings. The bearing sleeve extends along an axial length defined by a rotational axis of the shaft, and has a turbine rotor end adjacent to the turbine rotor, and a remote end. A radially outwardly extending flange on the bearing sleeve extends radially outwardly of a support portion of the bearing sleeve at the turbine rotor end. The flange has a nominal outer diameter, and includes a slot for receiving an anti-rotation tab from a gear cage over a first circumferential extent.

A bearing sleeve incorporating the anti-rotation feature, a gear cage incorporating its portion of the anti-rotation feature, an air turbine starter, and a method of installing components of a turbine balance assembly are also disclosed and claimed.

These and other features of the present invention can be best understood from the following specification and drawings, the following of which is a brief description.

DETAILED DESCRIPTION

Figure 1:
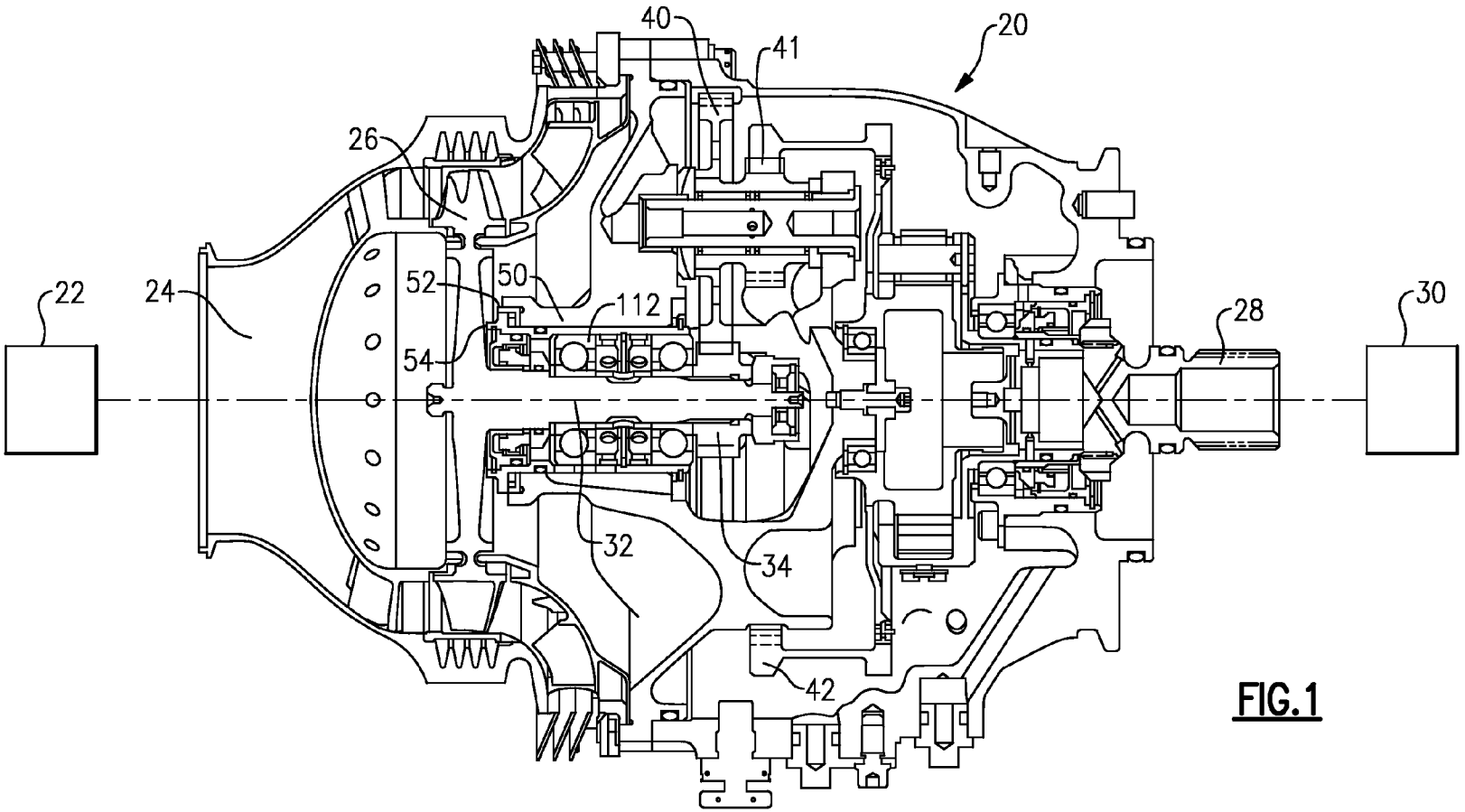
FIG. 1 shows an air turbine starter turbine assembly.

An air turbine starter turbine assembly 20 may be associated with an aircraft, or other systems including a gas turbine engine. A source of hot air 22, which may be an auxiliary power unit, as typically utilized while on the ground, delivers hot, high pressure air into an inlet 24. The high pressure air flows across a turbine rotor 26, causing the turbine rotor 26 to rotate. As the turbine rotor 26 rotates, it rotates an output shaft 28 through a planetary gear system. The output shaft 28 may be utilized as a starter, to start operation of a main gas turbine engine 30.

A planetary gear system includes a sun gear 34 that is driven by a turbine shaft 32 that rotates with the turbine rotor 26. The sun gear 34 in turn drives a plurality of planet gears 40. The planet gears 40 include output gear teeth 41, which drive a ring gear 42. The ring gear 42 drives the output shaft 28 through a mechanical connection.

In addition, a bearing sleeve 54 is supported within a gear cage 50. As can be seen, a plurality of bearings 112 are surrounded by the bearing sleeve 54, and support the turbine shaft 32. An anti-rotation connection between the gear cage 50 and the bearing sleeve 54 is provided in part by a liner 52.

Figure 2B:
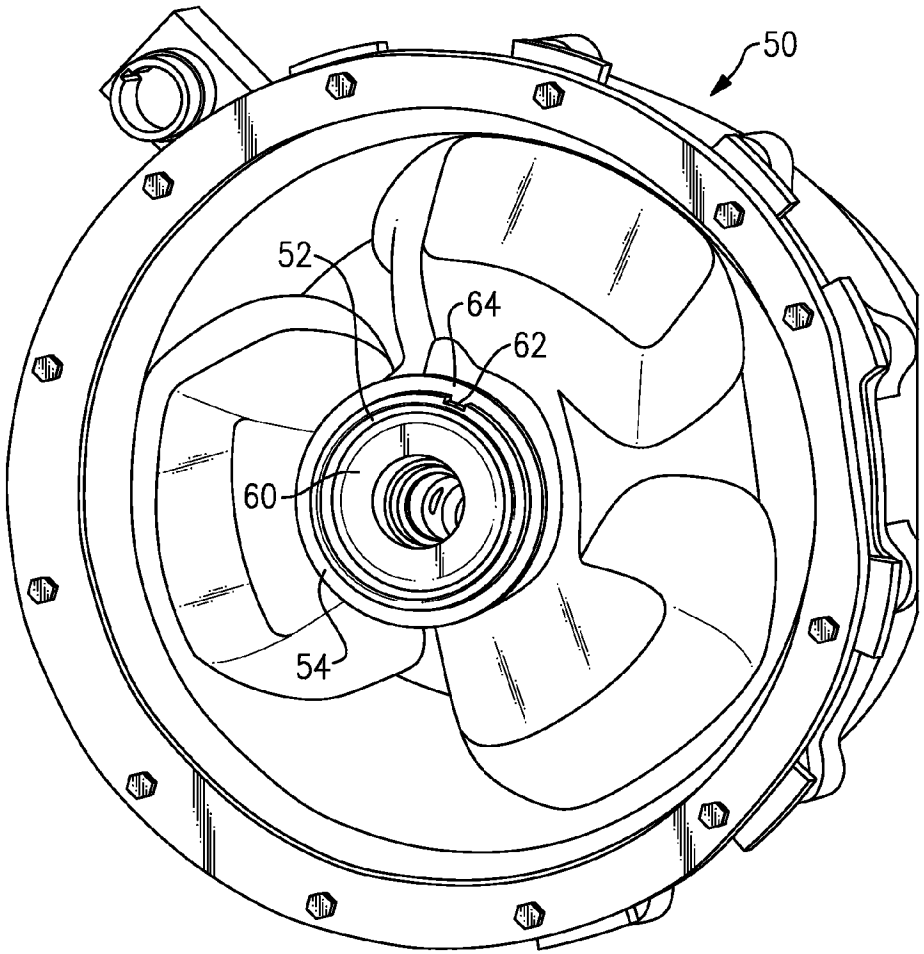
FIG. 2B shows a gear cage and bearing sleeve combination.
Figure 2A:
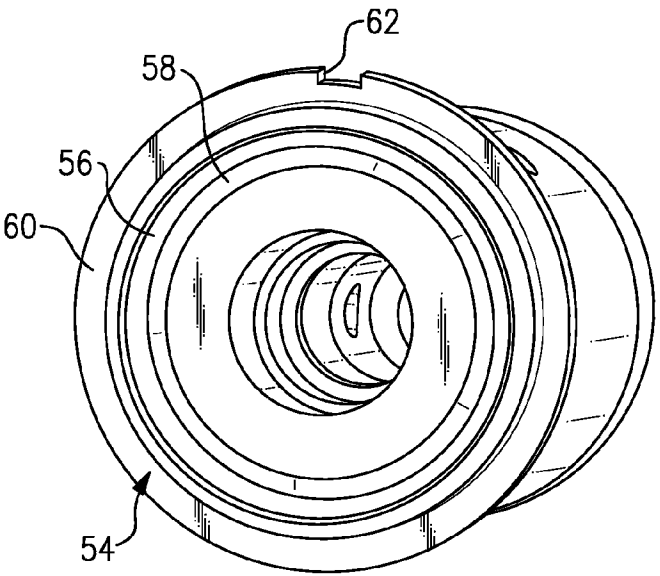
FIG. 2A shows a bearing sleeve.

FIG. 2A shows the bearing sleeve 54 having a flange 60, and an anti-rotation slot 62. A clip 56 secures an outer end 58 (the housing of the seal assembly) of the bearing assembly within the bearing sleeve 54.

FIG. 2B shows the bearing sleeve 54 mounted within a gear cage 50. The liner 52 is positioned intermediate the two. As can be seen, a tab 64 on the liner 52 fits into the slot 62 to provide an anti-rotation feature. As can be appreciated, this anti-rotation feature is at the rotor end of the air turbine starter turbine assembly 20, and thus any debris will fall outwardly into an air flow portion, rather than into a gear train portion of the assembly 20.

Figure 3:
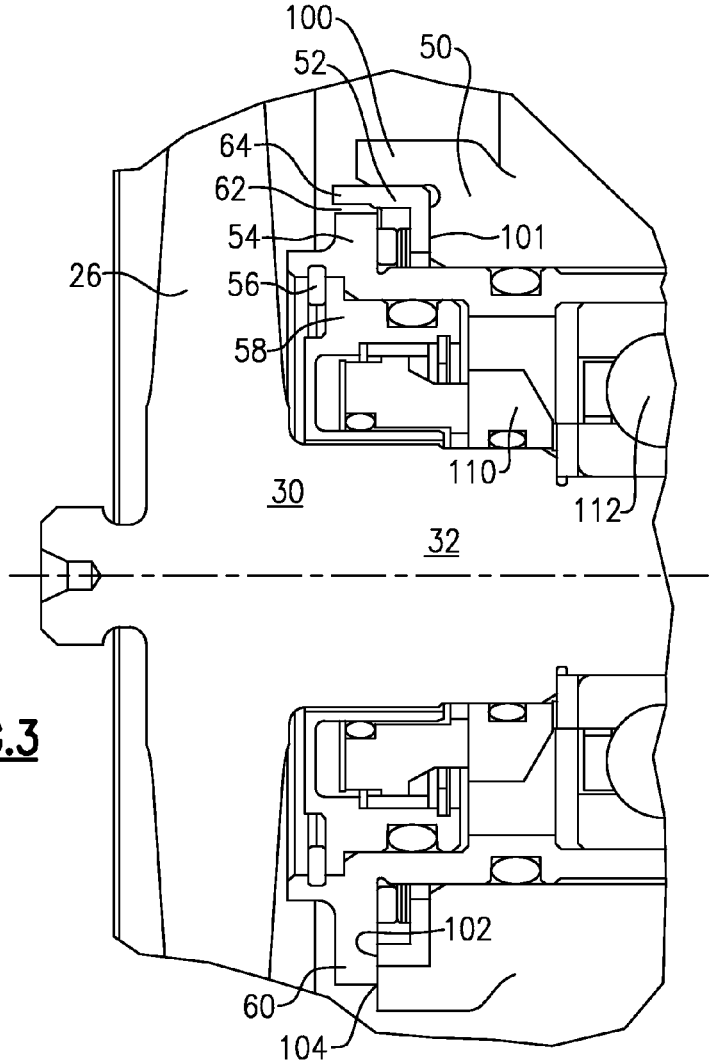
FIG. 3 shows a cross-section through the assembly of FIG. 1.

FIG. 3 shows a detail, showing the clip 56 securing the outer end 58, seal portions 110, and the bearings 112 about the shaft 32. As can be seen, the liner 52 is secured within an outer lip 100 of the gear cage 50. A flat face or surface 101 of the gear cage 50 provides a stop surface for the liner 52. A lower portion of the cage 50 and the liner 52 can be seen to have a machined-away face 102 and 104. These faces do not extend axially as far toward the rotor 26 as tab 64 portion 100. Instead, the portion 100, and the tab 64 as shown in the top portion of FIG. 3 extend only over a very limited circumferential extent to provide the locking feature. Elsewhere, the flange 60 of the bearing sleeve 54 sits adjacent both surfaces 102 and 104. In one embodiment, a stack of shims, for example one thick and three thinner ones, set the axial position of the bearing sleeve 54, and thus the turbine rotor 26, such that the bearing sleeve 54 does not typically abut surfaces 102 and 104. This is done to achieve a specific axial clearance between the rotor and another part of the starter.

Figure 4A:
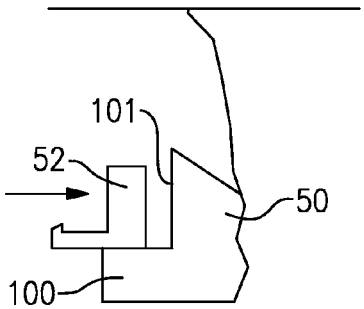
FIG. 4A shows a first fabrication step.

FIG. 4A shows a first step in the assembly of the gear cage 50. As shown, the gear cage 50 has surfaces 101 and 100, and the liner 52 is force fit into the opening formed between the surfaces 100 and 101. The liner 52 may be made of a relatively hard metal, such as steel, while the gear cage 50 may be made of aluminum. Notably, the bearing sleeve 54 may also be made of steel. Thus, the anti-rotation function will be provided by steel on steel contact. Of course, other materials could come within the scope of this invention.

Figure 4B:
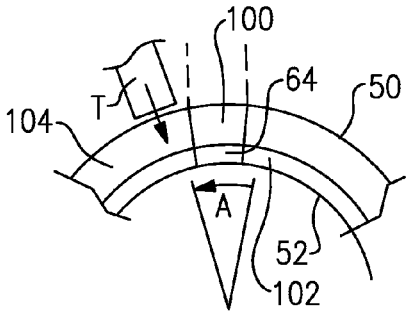
FIG. 4B shows a subsequent fabrication step.

FIG. 4B shows a subsequent step. Once the liner 52 is force fit into the cage 50, a tool T machines away the bulk of the material such that almost all of the gear cage 50 and liner 52 sit further away from the rotor, such as in the lower portion of FIG. 3. However, over a limited circumferential angle A, the anti-rotation tab 64 and the extending portion 100 are found. The angle A is between 4° and 12° in one embodiment. It should be understood that after this machining, the bearing sleeve 54 with the rest of the turbine balance assembly (the bearings 112, the seals 110, the rotor 26 and shaft 32) can all be inserted into the gear cage 50, and the anti-rotation function is provided by the inter-lock between tab 64 and slot 62.

Figure 5:
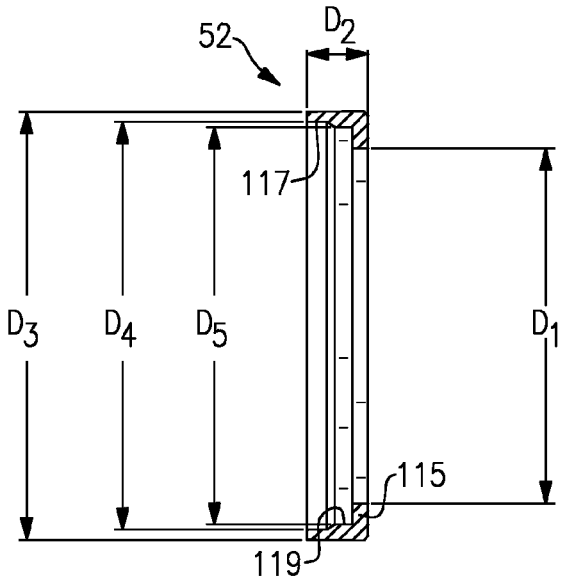
FIG. 5 shows a detail of a liner.

FIG. 5 shows a detail of the liner 52. As shown, a forward end 117 of the liner 52 has a greater interior diameter than a more remote portion 119. The inner diameter of an inner end 115 of the liner is at a distance $D_1$. In one embodiment, this distance was 1.97" (5.00 cm). The forwardly extending flange portion of the liner 52 extends for a distance $D_2$. In one embodiment, this distance was 0.181" (0.460 cm). The outer diameter $D_3$ of the liner 52 was 2.34" (5.94 cm). The inner diameter of the portion 117 is at a diameter $D_4$ and in one embodiment 2.25" (5.71 cm). The inner diameter of the more interior portion 119 was at a diameter $D_5$, and in one embodiment 2.21" (5.61 cm). Of course, other diameters may be utilized.

The eventual tab 64 will be formed in the portion 117.

Taking the dimensions $D_1$, $D_4$ and $D_5$ into account, the following description of the liner 52 can also be made. The tab 64 has an inner diameter $D_4$ that is greater than an inner diameter $D_5$ of a cylindrical more remote portion 119 of the liner connecting the tab 64 to an inner end 115 of the liner. The inner end 115 has a bore defining an inner diameter $D_1$. The tab 64 thus has an inner face spaced from a center of the liner 52, and the tab inner face is spaced further from the center axis 115 than an inner face of the cylindrical more remote portion 119. The inner face of the cylindrical more remote portion 119 is spaced from the center axis by a greater distance than is the inner bore of the inner end 115 of the liner.

A ratio of the inner diameter $D_4$ of the portion 117, to the outer diameter $D_3$ of the overall liner is between 0.92 and 0.98.

A ratio of $D_2$ to $D_4$ is between 12.5 and 4.5.

Figure 6:
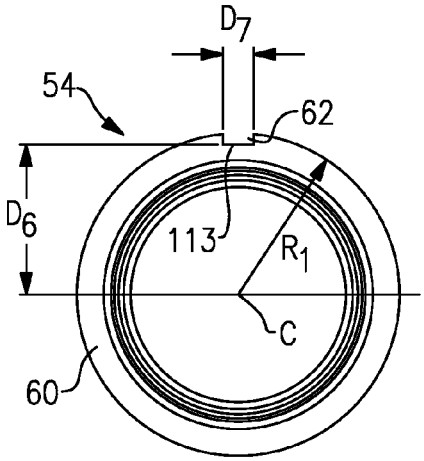
FIG. 6 shows a detail of the bearing sleeve.

FIG. 6 shows a detail of the bearing sleeve 54. As shown, the flange 60 sits at a nominal radius $R_1$ that was 1.175" (2.984 cm). The tab 62 has an inner end 113 which is at a tangent to a central axis C of the bearing sleeve 54. The surface 113 is at a distance $D_6$, and in one embodiment, that was 1.10" (2.79 cm). A width $D_7$ between the sides of the notch 62 in one embodiment was 0.208" (0.528 cm).

Figure 7:
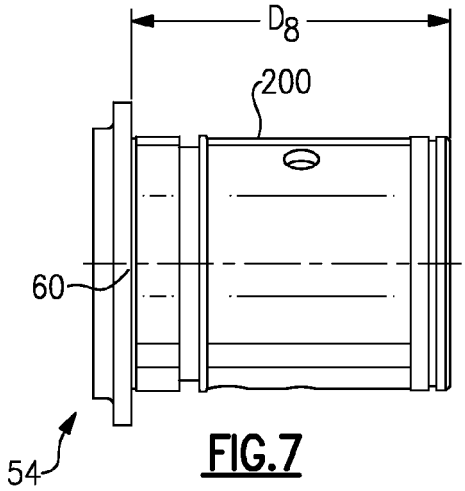
FIG. 7 shows a side view of the bearing sleeve.

As shown in FIG. 7, a length $D_8$ of a support portion 200 of the sleeve 54 was 2.33" (5.91 cm).

In embodiments, a ratio of the distances $D_6$ to $R_1$ was between 0.92 and 0.95. A ratio of the distance $D_7$ to the radius $R_1$ was between 0.09 and 0.22.

Figure 8A:
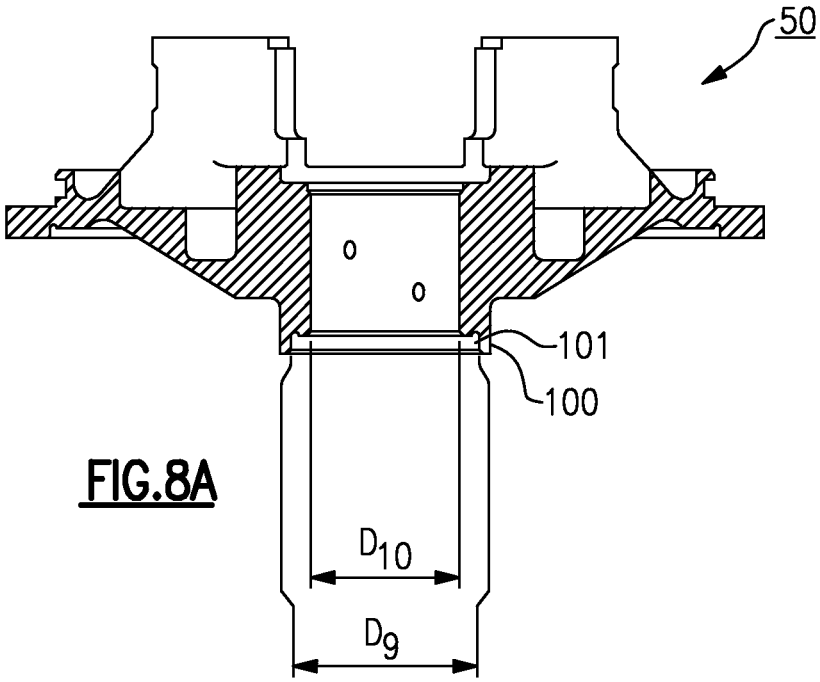
FIG. 8 shows a detail of the gear cage.
FIG. 8B shows a second detail of a gear cage.

FIG. 8A shows a detail of the gear cage 50. As shown, an inner diameter $D_9$ can be defined to the inner surface of the portion 100, and an inner diameter $D_{10}$ can be defined to the inner periphery of the nominal bore through the gear cage 50. In one embodiment, $D_{10}$ was 1.87" (4.74 cm), and $D_9$ was 2.24" (5.99 cm).

Figure 8B:
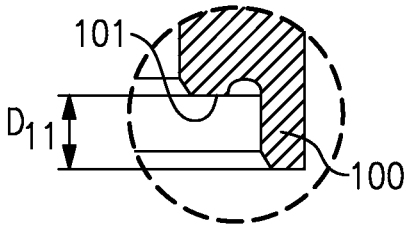

As shown in FIG. 8B, another distance $D_{11}$ can be defined between an end of the surface 101, and an outer end of the portion 110. The distance $D_{11}$ was 0.09 in one embodiment. A ratio of $D_9$ to $D_{11}$ was between 0.03 and 0.06.

Of course, other shapes and dimensions would come within the scope of this application.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A turbine balance assembly comprising:

a turbine rotor connected to drive a turbine shaft;

bearings positioned radially outwardly of said turbine shaft;

a bearing sleeve positioned radially outwardly of said bearings, and supporting said bearings, said bearing sleeve extending along an axial length defined by a rotational axis of said shaft, and said bearing sleeve having a turbine rotor end adjacent to said turbine rotor, and a remote end;

a radially outwardly extending flange on said bearing sleeve extending radially outwardly of a support portion of said bearing sleeve and at said turbine rotor end, and said flange having a nominal outer radius, and including a slot for receiving an anti-rotation tab over a limited circumferential extent;

a ratio between a distance from a center line of said bearing sleeve to a tangent point for a flat surface on a radially inner end of said slot relative to said nominal radius of the flange is between 0.92 and 0.95; and said slot extends for a distance along said flat surface between two sides, and a ratio of the distance between said two sides to said nominal radius is between 0.09 and 0.22.

2. The turbine balance assembly as set forth in claim 1, wherein said slot extends over an angle of between 4° and 12° to define said limited circumferential extent.

3. An air turbine starter comprising:

a turbine rotor connected to drive a turbine shaft;

bearings positioned radially outwardly of said turbine shaft;

a bearing sleeve positioned radially outwardly of said bearings, and supporting said bearings, said bearing sleeve extending along an axial length defined by a rotational axis of said shaft, and said bearing sleeve having a turbine rotor end adjacent to said turbine rotor, and a remote end;

a radially outwardly extending flange on said bearing sleeve extending radially outwardly of a support portion of said bearing sleeve and at said turbine rotor end, and said flange having a nominal outer diameter, and including a slot for receiving an anti-rotation tab over a limited circumferential extent;

a gear cage radially outwardly of said bearing sleeve, and including an anti-rotation tab extending into said slot to resist rotation of said bearing sleeve relative to said gear cage; and said gear cage is formed of an outer aluminum member having an inner bore, and a steel liner force fit into said inner bore, said tab being part of said steel liner.

4. The air turbine starter as set forth in claim 3, wherein said slot extends over an angle of between 4° and 12° to define said limited circumferential extent.

5. The air turbine starter as set forth in claim 3, wherein a ratio between a distance from a center line of said bearing sleeve to a tangent point for a flat surface on a radially inner end of said slot relative to said nominal radius of the flange is between 0.92 and 0.95.

6. The air turbine starter as set forth in claim 5, wherein said slot extends for a distance along said flat surface between two sides, and a ratio of the distance between said two sides to said nominal radius is between 0.09 and 0.22.

7. The air turbine starter as set forth in claim 3, wherein said tab and said outer aluminum member extend along the axial dimension closer to said rotor over a limited circumferential extent associated with said slot, and said steel liner and said gear cage having surfaces that are more removed from said turbine rotor at locations other than said limited circumferential extent.

8. The air turbine starter as set forth in claim 3, wherein said steel liner has the tab formed in an axially forward end spaced more toward said turbine rotor than a remote end, and there being an outer diameter of said steel liner, and a ratio of an inner diameter of said forward end to said outer diameter is between 0.92 and 0.98.

9. The air turbine starter as set forth in claim 8, wherein a ratio of said inner diameter of said forward end to an axial length of the entire steel liner is between 12.5 and 4.5.

10. A gear cage comprising:

an outer aluminum member having a cylindrical inner bore;

a steel liner force fit into said inner bore, a tab being formed as part of said steel liner, and said tab and said outer aluminum member extending along an axial dimension more forwardly than a nominal face of said liner and said outer aluminum member, and over a limited circumferential extent;

wherein said steel liner has the tab formed in an axially forward end that is to be spaced more toward a turbine rotor than a remote end, and there being an outer diameter of said steel liner, and a ratio of an inner diameter of said forward end to said outer diameter is between 0.92 and 0.98; and a ratio of said inner diameter of said forward end to an axial length of the entire steel liner is between 12.5 and 4.5.

11. A bearing sleeve comprising:

a support portion extending along a central axis, and having a flange at a turbine end extending radially outwardly;

said flange having a nominal outer radius, and a slot for receiving an anti-rotation lock over a limited circumferential extent, said slot extending over an angle of between 4° and 12° to define said limited circumferential extent; and said slot extends for a distance along said flat surface between two sides, and a ratio of the distance between said two sides to said nominal radius is between 0.09 and 0.22.

12. The bearing sleeve as set forth in claim 11, wherein a ratio between a distance from a center line of said bearing sleeve to a tangent point for a flat surface on a radially inner end of said slot relative to said nominal radius of the flange is between 0.92 and 0.95.

13. A method of assembling an air turbine starter comprising the steps of:

inserting a turbine rotor and shaft, and bearings supporting said shaft into a bearing sleeve to form a turbine balance assembly, and said bearing sleeve having a slot to receive an anti-rotation structure at an end of said bearing sleeve positioned toward said turbine rotor;

moving said turbine balance assembly into a gear cage, said gear cage having an anti-rotation tab and said tab being moved into said slot; and said gear cage is formed of an outer member having inner bore, and a liner force fit into said inner bore, with said liner providing the tab.

14. The method as set forth in claim 13, wherein said outer member and said liner initially have cylindrical forward surfaces, and said cylindrical forward surfaces of said outer aluminum member and said liner are machined away to leave said tab, and a portion of said cylindrical forward surfaces of said outer member over a limited circumferential extent prior to said turbine balance assembly being inserted within said gear cage.

15. The method as set forth in claim 14, wherein said liner is machined away to leave said tab, after said liner has been force fit into said gear cage.

16. The gear cage as set forth in claim 10, the tab has an inner diameter that is greater than an inner diameter of a cylindrical portion of the liner connecting the tab to an inner end of the liner, and wherein the inner end of liner defining an inner bore, and the tab having an inner face spaced from a center axis of the liner, and wherein the tab inner face is spaced further from the center axis than the inner surface of the cylindrical portion, and the inner face of the cylindrical portion is spaced from the center axis by a greater distance than is the inner bore of the inner end.

17. The air turbine starter as set forth in claim 3, the tab has an inner diameter that is greater than an inner diameter of a cylindrical portion of the liner connecting the tab to an inner end of the liner, and wherein the inner end of liner defining an inner bore, and the tab having an inner face spaced from a center axis of the liner, and wherein the tab inner face is spaced further from the center axis than the inner surface of the cylindrical portion, and the inner face of the cylindrical portion is spaced from the center axis by a greater distance than is the inner bore of the inner end.

* * * * *